US006843371B2

(12) United States Patent
Rivoltella

(10) Patent No.: US 6,843,371 B2
(45) Date of Patent: Jan. 18, 2005

(54) COMPOSITE PACKAGING MATERIAL HAVING A BASE LAYER OF PAPER AND AN ATTACHED ADDITIONAL LAYER OR TUBULAR SLEEVE ENVELOPE OF PLASTIC MATERIAL, PARTICULARLY FOR FOOD PRODUCTS, AND METHOD FOR OBTAINING IT

(75) Inventor: Luigi Rivoltella, S. Giovanni Reatino (IT)

(73) Assignee: Big Paper America, Inc., Toronto (CA)

( * ) Notice: Subject to any disclaimer, the term of this patent is extended or adjusted under 35 U.S.C. 154(b) by 392 days.

(21) Appl. No.: 09/739,663

(22) Filed: Dec. 20, 2000

(65) Prior Publication Data

US 2001/0017949 A1 Aug. 30, 2001

Related U.S. Application Data

(63) Continuation-in-part of application No. 09/613,810, filed on Jul. 11, 2000, now abandoned.

(30) Foreign Application Priority Data

Jul. 12, 1999 (IT) ..... RM9900158 U

(51) Int. Cl.[7] ..... B65D 85/84

(52) U.S. Cl. ..... 206/524.1; 428/34.3

(58) Field of Search ..... 206/524.1, 524.2, 206/466, 469, 525.1, 478; 426/106, 110; 428/34.2, 34.3, 34.5; 383/109, 41; 229/87.08, 87.09, 87.11, 117.27

(56) References Cited

U.S. PATENT DOCUMENTS 3,764,002 A * 10/1973 Spiegel et al. ..... 206/466
4,589,553 A * 5/1986 Ferrero ..... 206/525

FOREIGN PATENT DOCUMENTS

| | | |
|---|---|---|
| EP | 0 685 407 A1 | 12/1995 |
| FR | 2 513 219 | 3/1983 |
| GB | 2 273 279 A | 6/1994 |

OTHER PUBLICATIONS

Copy of International Search Report dated Nov. 2, 2000.

* cited by examiner

*Primary Examiner*—Shian T. Luong
(74) *Attorney, Agent, or Firm*—Smith, Gambrell & Russell, LLP

(57) ABSTRACT

A composite double component packaging material, particularly suited for food products, includes a first component, having a base sheet of paper material, upon which a second component formed from a tubular sleeve of a thin film of plastic material is adhered. This packaging material is of a type approved for use with food products. The sleeve member can be longitudinally cut at any suitable position to provide one or two free foldable flaps.

6 Claims, 2 Drawing Sheets

COMPOSITE PACKAGING MATERIAL HAVING A BASE LAYER OF PAPER AND AN ATTACHED ADDITIONAL LAYER OR TUBULAR SLEEVE ENVELOPE OF PLASTIC MATERIAL, PARTICULARLY FOR FOOD PRODUCTS, AND METHOD FOR OBTAINING IT

RELATED APPLICATION DATA

This application is a continuation-in-part based on U.S. patent application Ser. No. 09/613,810, now abandoned, filed Jul. 11, 2000, and it claims priority under 35 U.S.C. Section 119 based on Italian Patent Appln. No. RM99 U 000158, filed Jul. 12, 1999. These applications are entirely incorporated herein by reference.

BACKGROUND OF THE INVENTION

This invention broadly relates to packaging materials, and more particularly, it concerns a composite, double component, paper based packaging material, especially useful for packaging food products.

Although this specification should be understood as requiring no restrictive limitations on the use of the disclosed packaging materials, materials produced according to the invention have been found to be particularly useful in the field of packaging materials for the retail sale of food products, particularly single piece and discrete products, such as bacon, cheese, meats, dairy products and like.

As is well known, as a consequence of established general practices, and in order to comply with the increasingly more restrictive and binding hygienical regulations, food products offered for retail sale to the public often are packaged in wrappings consisting of sheets of paper based material that are wrapped around the product. Packaging using paper based packaging material must fulfill well established hygiene and safety requirements. Therefore, it has been for a certain time, and presently it is still, an accepted general practice to use composite wrappings comprising a paper based sheet, intended not to contact the food product, together with a thin film of a plastic material, as a food wrapping material. Such a composite wrapping complies with the legal hygiene and use safety regulations and requirements.

Such wrappings, however, have at least one deficiency. In fact, when aiming at preventing the concerned food product from contacting the external paper based material during the wrapping operation (which very often entails a rolling of the paper based material together with the food product contained therein, which often consists of a number of thin wafers), it is a common practice to use a second sheet of plastic material to directly cover the concerned food product. In this manner, even if the packaging material is to be very tightly wrapped, the concerned food product is always insulated and separated from the external paper based layer.

Even if it is certainly efficient, this approach always entails use of two materials of different kinds, with the consequent problems of storage, inventory, separate housing compartments and like. Furthermore, the handling of the materials entails an increased risk of contamination of the surfaces contacting the concerned food product.

SUMMARY OF THE INVENTION

It is an object of this invention to improve this kind of packaging materials and to provide a composite double component packaging material that is easy to manufacture, easy to store, and easy to apply, while at the same time, providing better performance than that offered by conventional packagings, even the most recently developed ones. Furthermore, the second component of the double component packaging material is substantially realized as a sleeve member that is very versatile, so that, with simple operations and provisions, many variations can be obtained with many possible application possibilities.

This invention, therefore, relates to a composite double component packaging material, particularly useful for wrapping food products, which comprises a first component acting as a support paper base layer, upon which a second component is adhered. The second component comprises a tubular sleeve made from a thin film of a material hygienically acceptable for contact with food products. This tubular sleeve has a transversal size smaller than, equal to, or larger than the transversal size of the paper base layer, depending upon the application for which the product is intended.

Such a tubular sleeve enables that, once the product to be packaged is inserted into the tubular sleeve, the assembly can be rolled or folded while the base paper sheet is outwardly maintained, with a full and complete guarantee that, whichever rolling or folding operation is carried out, the packaged food product will only and exclusively contact the inner surface of the tubular sleeve, and it will never contact the external surface of the tubular sleeve. The food product is even less likely to contact any portion of the paper base sheet.

A sleeve member with an equal or preferably larger transversal dimension than that of the base layer enables one to obtain, by means of a simple longitudinal cutting operation of the sleeve material, a composite double-layer packaging material, comprising a first support layer having a second layer adhered thereto. The second layer comprises the thin film of the sleeve member described above, longitudinally cut with dimensions equal to or preferably larger than the dimensions of the first support layer, so as to form at least one foldable flap designed to be folded upon the food product laid upon the package and to be preferably overlapped upon itself.

Both components of the packaging material can be provided with one or more longitudinal weakness lines, for instance a nearly central weakness line, so as to make it possible to remove a half portion of the whole package and to thereby uncover only a portion of the packaged food product, for instance a hot dog to be consumed, while the other half portion of the package is maintained in place as a protective cover for the food product. Of course, the weakness lines may be located at any place on the composite packaging material. For instance, instead of centrally located, the weakness lines may be located at a laterally offset position.

It also is possible to provide a transversal welding on one end edge of the double component packaging material in order to obtain a bag like package.

BRIEF DESCRIPTION OF THE DRAWINGS

Further details and advantages of this invention will be apparent from the following detailed description with reference to the annexed drawings in which the preferred embodiments are shown by way of illustration and not by way of limitation.

In the drawings.

DETAILED DESCRIPTION OF THE INVENTION

Figure 1:
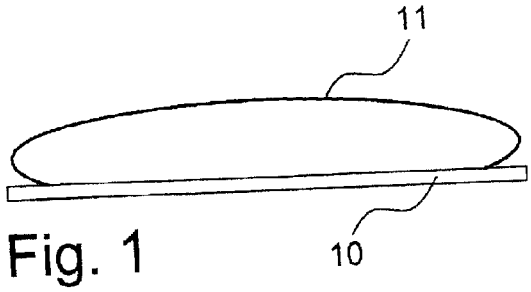
FIG. 1 is a cross-sectional view of a composite double component packaging sheet material according to this invention.

Referring now to FIG. 1 of the drawings, a first embodiment of this invention comprises a first component 10, comprising a base sheet of paper material, upon which a second component 11 formed as a tubular sleeve of a thin film of plastic material is applied. This second component 11 is a plastic material of a kind approved for use with food products. The tubular sleeve 11 may be made of polyethylene or a similar material, manufactured by conventional extrusion methods. It also may be adhered to the paper base sheet 10 by means of conventional methods and equipment, for instance by gluing.

In this first embodiment, a characterizing feature of the thin film tubular sleeve 11 is that, for convenience of use and functionality reasons, it has a transversal dimension not larger than the base sheet 10, and particularly it can be narrower than the base sheet 10, so as to leave a certain free edge on one or on both sides. Upon introducing the concerned food product into the sleeve, the product is retained in a covered and protected condition. The upper flap of the sleeve 11 performs the same function as that performed by a second separate overposed sheet of plastic material according to the present state of the art as described above.

Figure 2:
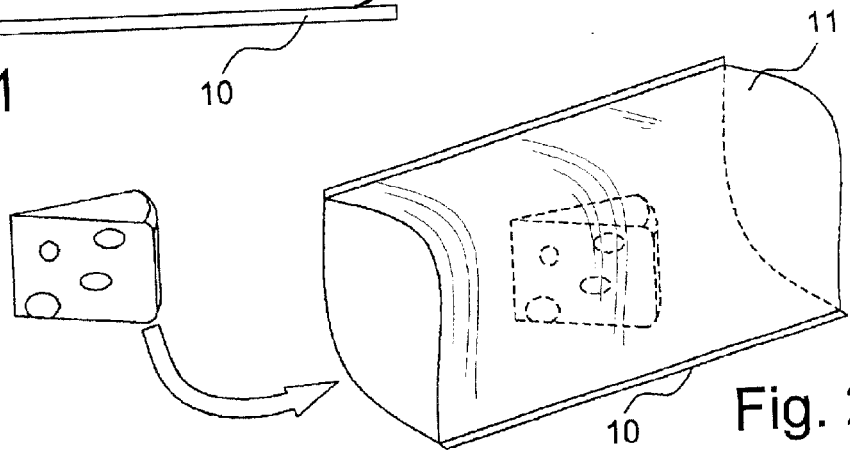
FIG. 2 is a perspective view of a composite double component packaging sheet material according to the invention with a tubular sleeve in a partially open condition, in order to show how the product is inserted therein.

Referring to FIG. 2 of the drawings, the initial step for use of the packaging material is shown, in which the upper flap of the tubular sleeve 11 is slightly lifted so that the food product can be introduced into the sleeve 11.

Figure 3:
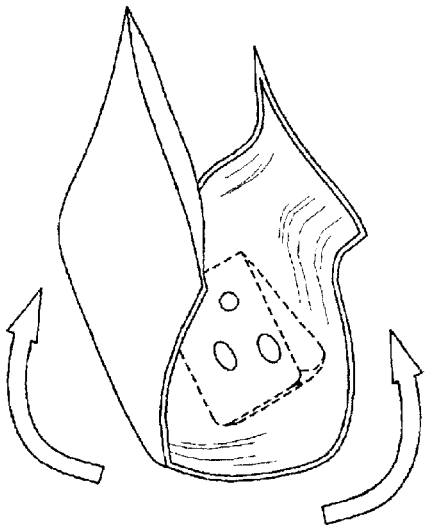
FIG. 3 is a perspective view of a package according to the invention containing a food product while it is being folded.

FIG. 3 shows the subsequent step for use in which the package is folded. The folding mode is self-explanatory, but it should be understood that the folding step can also be carried out as a rolling step. Additionally, such folding or rolling steps can also be performed in a different direction with respect to the illustrated one, without departing from the scope of this invention.

Figure 4:
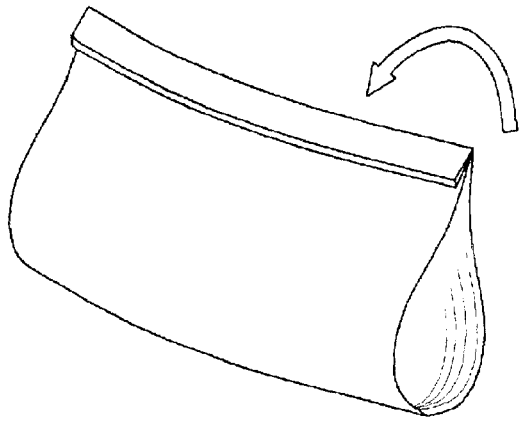
FIG. 4 shows the final stage of the folding sequence of the package of FIG. 3, in which the open flaps are hermetically sealed.
Figure 5:
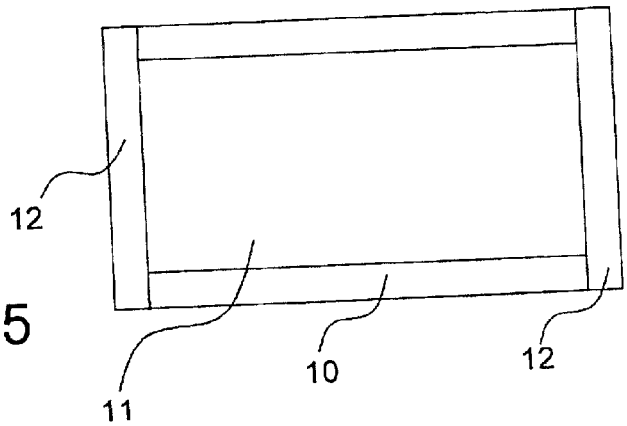
FIG. 5 is a plan top view of a different embodiment of the invention having two longitudinal flaps adapted to be glued.

By referring to FIGS. 4 and 5, it can be observed that the simplest procedure for hermetically closing the package provides that the longitudinal flaps be folded. In this respect, however, the possibility is to be mentioned for the tubular sleeve 11 to have a longitudinal dimension even smaller than the longitudinal dimension of the base sheet 10, so as to leave one or two free longitudinal edges 12 of the base sheet. Such free edges 12 can be provided with suitable glue stripes, for instance, a pressure responsive or sensitive adhesive, so as to make the hermetical closure operation of the package more immediate and certain, as illustrated in FIG. 4. Such pressure responsive or sensitive adhesive glue stripes may be adapted to be protected before use by detachable cover strips, so as to activate the gluing effect only at the desired time. Such adhesives and removable cover stripes are conventional and well known to those skilled in the adhesive arts.

As above mentioned, the adhesion between the base sheet 10 and the thin plastic material tubular sleeve 11 overlaid thereupon can be effected by means of any desired method and equipment. It is suggested, however, that the adhesion not extend to the whole contacting surfaces, so as to leave a not adherent peripheral edge designed to aid lifting of the upper flap of the sleeve 11.

The package according to this invention allows for a more prolonged storage of the food product contained therein. This package also has the advantage that it eliminates any possibility that the operator, for instance, an employee at a gastronomy bench, will inadvertently contact the inner surface of the packaging sleeve, thereby providing the possibility of handling the package as a whole with little or no risk of hygienic contamination. Furthermore, the extremely easy procedure to be followed for closing the package by a simple folding operation with possible optional adhesion of its longitudinal edges enables the consumer to re-use the package or, if desired, only its tubular sleeve for disposal of any resulting residuals.

Figure 6:
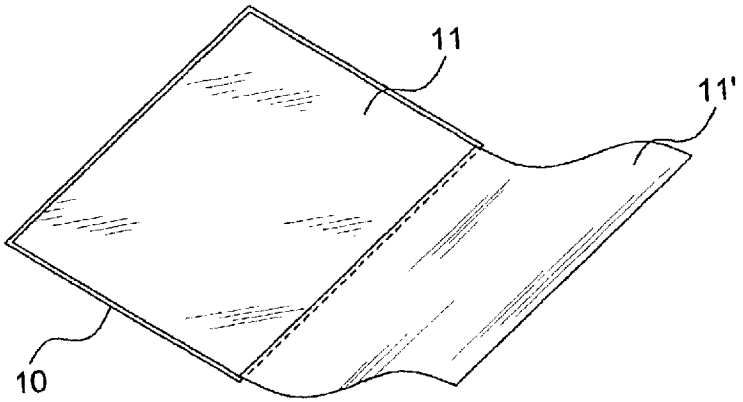
FIG. 6 is a perspective view of a composite double-layer packaging sheet material according to the invention, having an overlapping and foldable flap, obtained by longitudinally cutting the sleeve-like second component, the second component having a transversal dimension equal to the corresponding transversal dimension of the support paper base layer.

Referring to FIG. 6 of the drawings, a second embodiment of the invention can be observed. In this embodiment, which should not be construed as limiting or restricting the invention, the sleeve component 11 has a transversal dimension equal to (or substantially equal to) the corresponding transversal dimension of the support base sheet 10, and the sleeve member 11 can be longitudinally cut or torn, at a lateral position, so as to form a free flap 11'. After the flap 11' has been opened and the food product has been laid on the double-layer portion of the packaging sheet (i.e., base sheet 10 and bottom sleeve component 11), the so formed free flap 11' is folded over and laid upon the food product. In this manner, the free flap 11' performs the same function as that performed by the second separate sheet of plastic material according to the state of the art described above.

Figure 7:
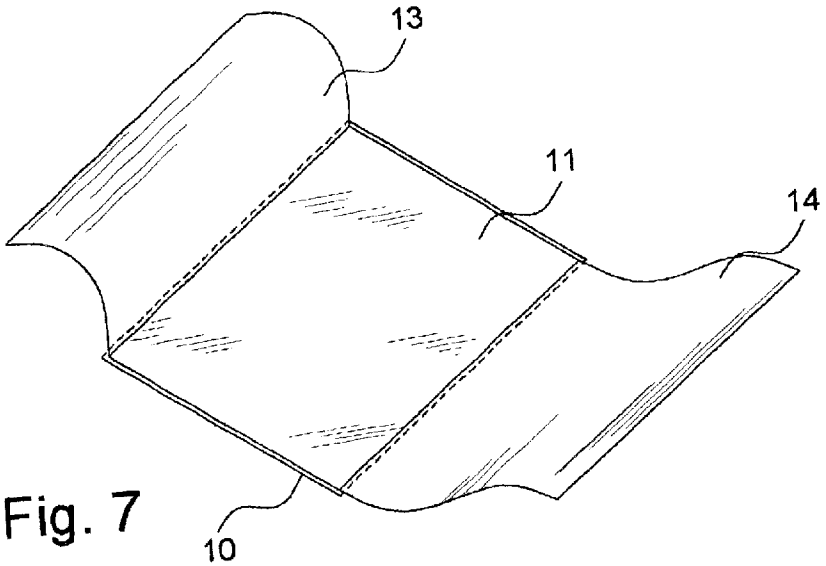
FIG. 7 is a perspective view of a composite double-layer packaging sheet material according to the invention having two foldable and overlapping flaps, obtained by longitudinally cutting the sleeve-like second component, the second component having dimensions larger than the corresponding dimensions of the support paper base layer.

Referring now to FIG. 7 of the drawings, a further embodiment of this invention is illustrated. This embodiment again comprises a first component acting as a support base sheet 10, with a sleeve like second component 11 having a transversal dimension much larger than the corresponding transversal dimension of the support base sheet 10. In this embodiment, however, the sleeve member 11 has been longitudinally cut or torn at about its central position, so as to form two free flaps 13 and 14. After the flaps 13 and 14 have been opened and the food product has been laid on the double-layer portion of the packaging sheet (i.e., on base sheet 10 and bottom sleeve component 11), the so formed free flaps 13 and 14 are folded over and laid upon the food product. In this manner, the free flaps 13 and 14 perform the same function as that performed by the second separate sheet of plastic material according to the state of the art described above. Depending on the dimensions of the sleeve like member 11, upon folding, the free flaps 13 and 14 may only be intermediately juxtaposed, or they can also slightly overlap one another in the intermediate area, so as to increase the coverage effect upon the food product. Of course, the longitudinal cut or tear in the sleeve member 11 can be made at any suitable location laterally away from the sleeve center, if desired.

Figure 8:
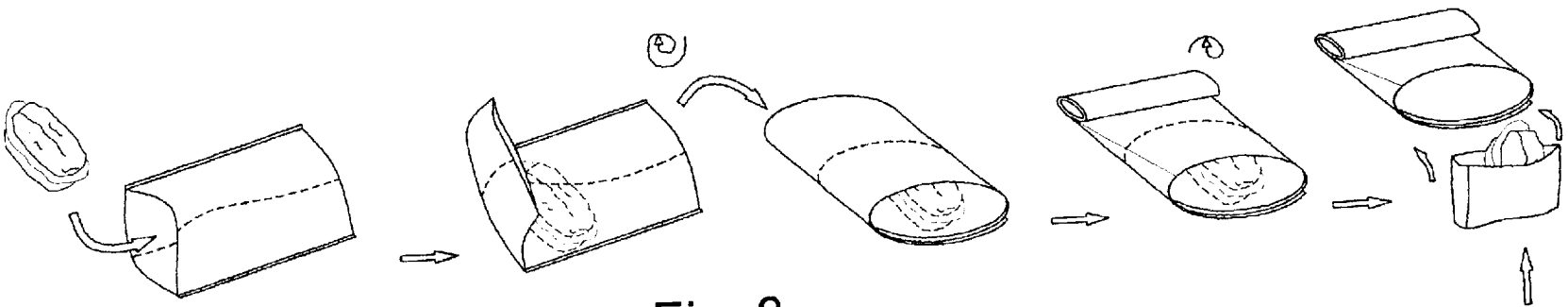
FIG. 8 shows a sequence of use of a package having both components longitudinally scored in order to wrap a consumable food product and adapted to divide the package into two separate half portions by a simple tearing operation.

FIG. 8 shows a sequence of use of a package according to this invention, in which a weakness line has been provided, for instance by scoring, in both components of the package. This embodiment has been found to be very useful for packaging food products intended for extemporaneous consumption, for instance, a hot dog or a piece of pizza. After the food product has been inserted into the package (first stage) and the package has been folded (second stage), rolled up (third stage), and possibly closed at its bottom edge (fourth stage), a half portion of the package can be torn off (fifth stage) at the illustrated scoring lines, so that the other half portion continues acting as a cover for the involved product and only the uncovered portion thereof is accessible for consumption. The remaining half portion of the package then acts like a pocket which enables the contents to be withdrawn by a pushing action exerted on the external side of the package, thereby avoiding any risk of soiling one's hands or contaminating the contents of the package.

It has already been mentioned, but it is now desired to underscore, that the two component package can be transversely welded at one end edge, so as to provide a bag like package.

As above mentioned, adhesion between the base sheet 10 and the thin plastic material film 11 overposed thereupon can be effected by means of any desired method and equipment. It is suggested, however, that the adhesion not extend over the entire contacting surfaces, so as to leave a not adherent peripheral edge designed to aid folding or lifting of the upper flap or flaps.

The preferred embodiments of this invention have been heretofore described, but it should be expressly understood that those skilled in the art can make changes and modifications to the details and to the material compositions, as well as to the thicknesses and the shapes of the packaging materials, without departing from the spirit and scope of this invention as defined in the annexed claims.

What is claimed is:

1. A composite double-layer packaging material, for containing a food product, said packaging material comprising:

a first paper support layer having a first surface and a second surface, and a second layer adhered to and substantially covering the first surface of the first layer so as to form a double-layer sheet, the second layer being a thin tubular film of plastic material, wherein the thin film has a longitudinal cut extending an entire longitudinal length of the film so as to form at least one foldable free flap, and wherein said packaging material is foldable and rollable such that the first layer rolls to surround the second layer and a food product received in the second layer with substantially only the second surface of the first layer exposed.

2. A composite double-layer packaging material according to claim 1, wherein the thin film forms two opposed foldable free flaps.

3. A composite double-layer packaging material according to claim 2, wherein the two opposed foldable free flaps are foldable so as to be intermediately juxtaposed.

4. A composite double-layer packaging material according to claim 2, wherein the two opposed foldable free flaps are foldable so as to overlap one another.

5. The composite double-layer packaging material according to claim 1, wherein the second layer is attached to said first layer such that when said first layer is folded, the second layer is also foldable in a similar manner.

6. The composite double-layer packaging material according to claim 1, wherein the first layer includes at least one longitudinal weakness line along which the first layer can be torn, and the second layer includes at least one correspondingly located weakness line along which the second layer can be torn.

* * * * *